US006032988A

United States Patent [19]

Klein

[11] Patent Number: 6,032,988

[45] Date of Patent: Mar. 7, 2000

[54] DRAWBOLT FOR LUGGAGE OR THE LIKE

[75] Inventor: Helmut Klein, Velbert, Germany

[73] Assignee: Franzen International, Inc., Oakland, N.J.

[21] Appl. No.: 09/040,417

[22] Filed: Mar. 18, 1998

[30] Foreign Application Priority Data

Mar. 18, 1997 [DE] Germany ..... 297 04 939 U

[51] Int. Cl.[7] ..... E05C 5/00

[52] U.S. Cl. ..... 292/247; 292/113; 70/73

[58] Field of Search ..... 292/113, 247, 292/246, 248, 283, DIG. 49, 114; 70/73, 74, 75, 76, 6, 8, 9, 11

[56] References Cited

U.S. PATENT DOCUMENTS

| | | | |
|---|---|---|---|
| 1,482,875 | 2/1924 | Walker et al. | 292/246 |
| 2,300,509 | 11/1942 | Komenak | 70/76 |
| 2,798,371 | 7/1957 | Gehrie | 70/73 |
| 2,970,858 | 2/1961 | Norrenberg-Sudhaus | 292/283 |
| 3,008,320 | 11/1961 | Cheney | 292/113 |
| 3,125,874 | 3/1964 | Gehrie | 70/75 |
| 3,584,906 | 6/1971 | Budzyn | 292/247 |
| 3,998,077 | 12/1976 | Bako | 70/74 |
| 4,008,584 | 2/1977 | Wingert | 70/73 |
| 4,074,549 | 2/1978 | Yee | 70/75 |
| 4,300,794 | 11/1981 | Dunsmoor | 292/247 |
| 4,428,608 | 1/1984 | Cooke et al. | 292/247 |
| 4,627,650 | 12/1986 | Hauschulte | 292/113 |
| 4,679,833 | 7/1987 | Dueringer | 292/113 |
| 5,505,065 | 4/1996 | Hesse | 70/73 |

*Primary Examiner*—Teri Pham

*Attorney, Agent, or Firm*—Vorys, Sater, Seymour and Pease LLP

[57] ABSTRACT

A drawbolt for luggage cases or the like comprises a base plate, an actuating lever, and a U-shaped latch member. The actuating lever is pivotally connected to the base plate for movement between a latched position and an unlatched position. A U-shaped link connects the actuating lever and the arms of the U-shaped latch member. The U-shaped link has arms formed as plates that are received in pockets at the sides of the actuating member. The actuating lever has a back cover with a cavity that receives the cross-bar of the U-shaped link, and the base plate has a recess that receives the cavity when the actuating lever is in the latched position. A lock bolt is supported on the actuating lever for movement parallel to the opposite sides of the actuating lever and enters an eccentric bolt socket on the base plate to lock the actuating lever in the latched position. Rivet holes are provided through the base plate and are covered by the actuating lever in the latched position.

11 Claims, 7 Drawing Sheets

DRAWBOLT FOR LUGGAGE OR THE LIKE

BACKGROUND OF THE INVENTION

This invention is concerned with drawbolts for luggage or the like and is more particularly concerned with improvements in a drawbolt of the type disclosed in U.S. Pat. No. 3,584,906 (incorporated herein by reference). That drawbolt comprises a mounting plate (base plate), a manually operable actuating lever (referred to in the patent as a latch member) pivotally connected to the mounting plate, a U-shaped latch member (referred to in the patent as a loop member), and a U-shaped link that couples the actuating lever to the U-shaped latch member. The drawbolt is constructed such that the actuating lever is pivotable between a latched position in which the actuating lever lies against the mounting plate and is embraced by the U-shaped latch member, and an unlatched position in which both the actuating lever and the U-shaped latch member tilt away from the mounting plate. The drawbolt is mounted on one section of a container by screws and cooperates with a latch member mounted on another section of the container by screws. The drawbolt is provided with a lock for maintaining the actuating lever in its latched position.

BRIEF DESCRIPTION OF THE INVENTION

Some of the features of the invention will be briefly described. The new drawbolt is constructed so that it can be riveted to a section of a container without interfering with the design height. The arms of the U-shaped link are formed as plates that are received in pockets at opposite sides of the actuating lever when the actuating lever is in the latched position. The cross-bar of the U-shaped link is received in a cylindrical-section mounting cavity on a back cover of the actuating lever, and notches are provided in pocket-forming webs of the actuating lever to receive portions of the cross-bar adjacent to the plates of the U-shaped link. When the actuating lever is in the latched position, pivot pins at the extremities of the plates, by which the plates are pivotally connected to the arms of the U-shaped latch member, are received in notches at opposite sides of the actuating lever; the plates are received in recesses in the base plate; and the mounting cavity on the back cover is received in a cylindrical-section recess in the base plate.

A lock bolt is supported between the actuating lever and the back cover for movement substantially parallel to opposite sides of the actuating lever. A socket for receiving the lock bolt is disposed eccentrically on the base plate. A pair of holes are provided through the base plate to receive rivets. One of the holes is disposed between the bolt socket and the pivotal connection of the actuating lever to the base plate, and the other hole is disposed laterally of the bolt socket. When rivets are used, they are covered by the actuating lever in the latched position, and are thus concealed and protected.

BRIEF DESCRIPTION OF THE DRAWINGS

The invention will be further described in conjunction with the accompanying drawings, which illustrate a preferred (best mode) embodiment of the invention, and wherein.

DETAILED DESCRIPTION OF THE INVENTION

Figure 2:
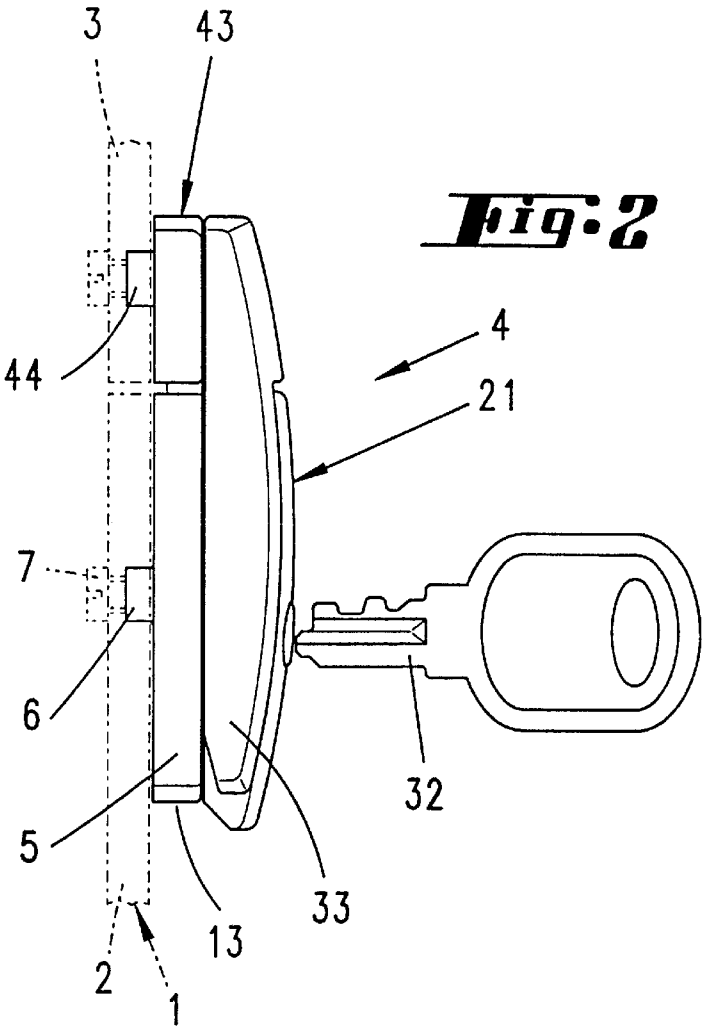
FIG. 2 a side elevation view of the drawbolt and a cooperable latch member mounted on an adjacent section of the container, a key being shown for operating a lock on the drawbolt.
Figure 1:
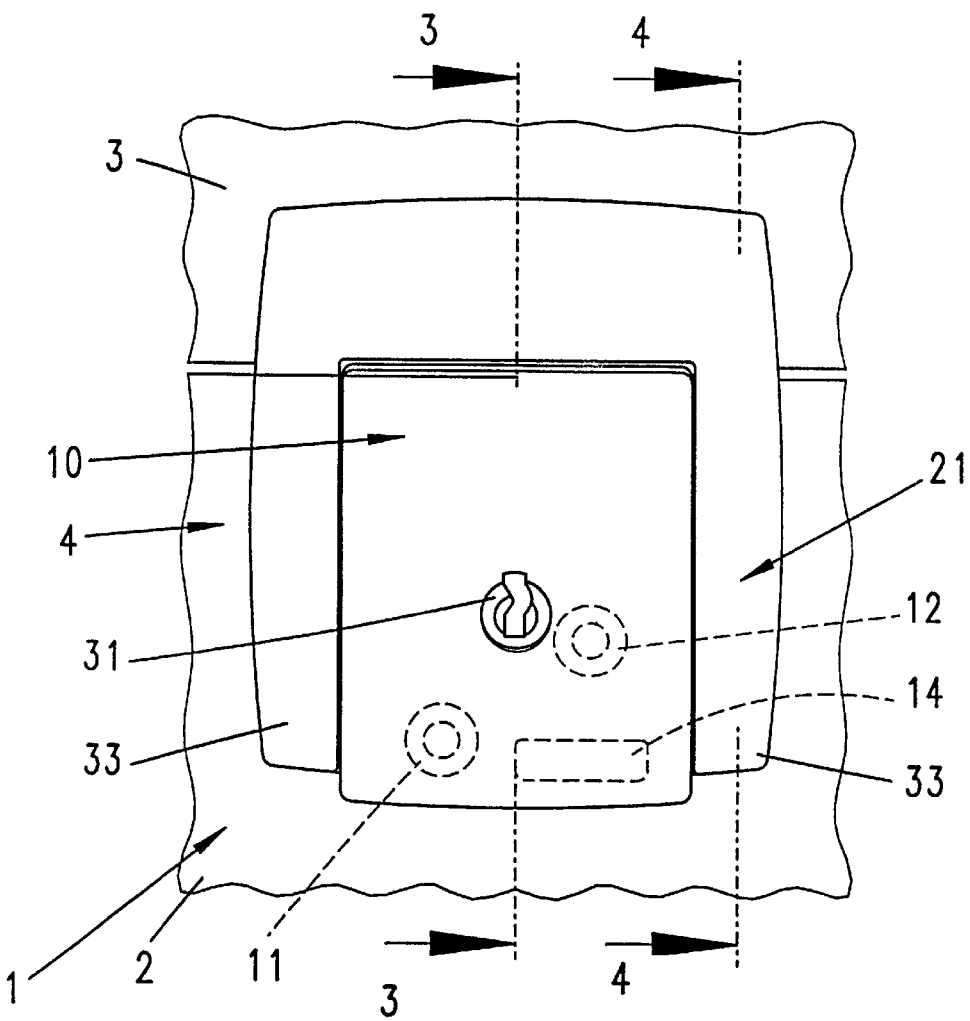
FIG. 1 is a front elevation view of a drawbolt of the invention shown mounted on a section of a container such as a luggage case, the drawbolt being shown in a latched position.

FIGS. 1 and 2 show a drawbolt 4 of the invention mounted on a section 2 of a container 1, such as a bottom section of a luggage case, near the parting line with another section 3, such as a lid of the luggage case. At a side of the container opposite to the side to which the drawbolt is attached, the sections 2 and 3 may be connected by hinges.

The drawbolt 4 comprises a base plate 5 having internally threaded collars 6 that project rearwardly from the base plate into openings in a wall of the container section 2 and that receive screws 7 for attachment of the base plate to the container. Two or more such collars 6 may be provided. The fixing of the base plate 5 to the container may, however, be carried out, alternatively, by riveting, as described later.

Figure 9:
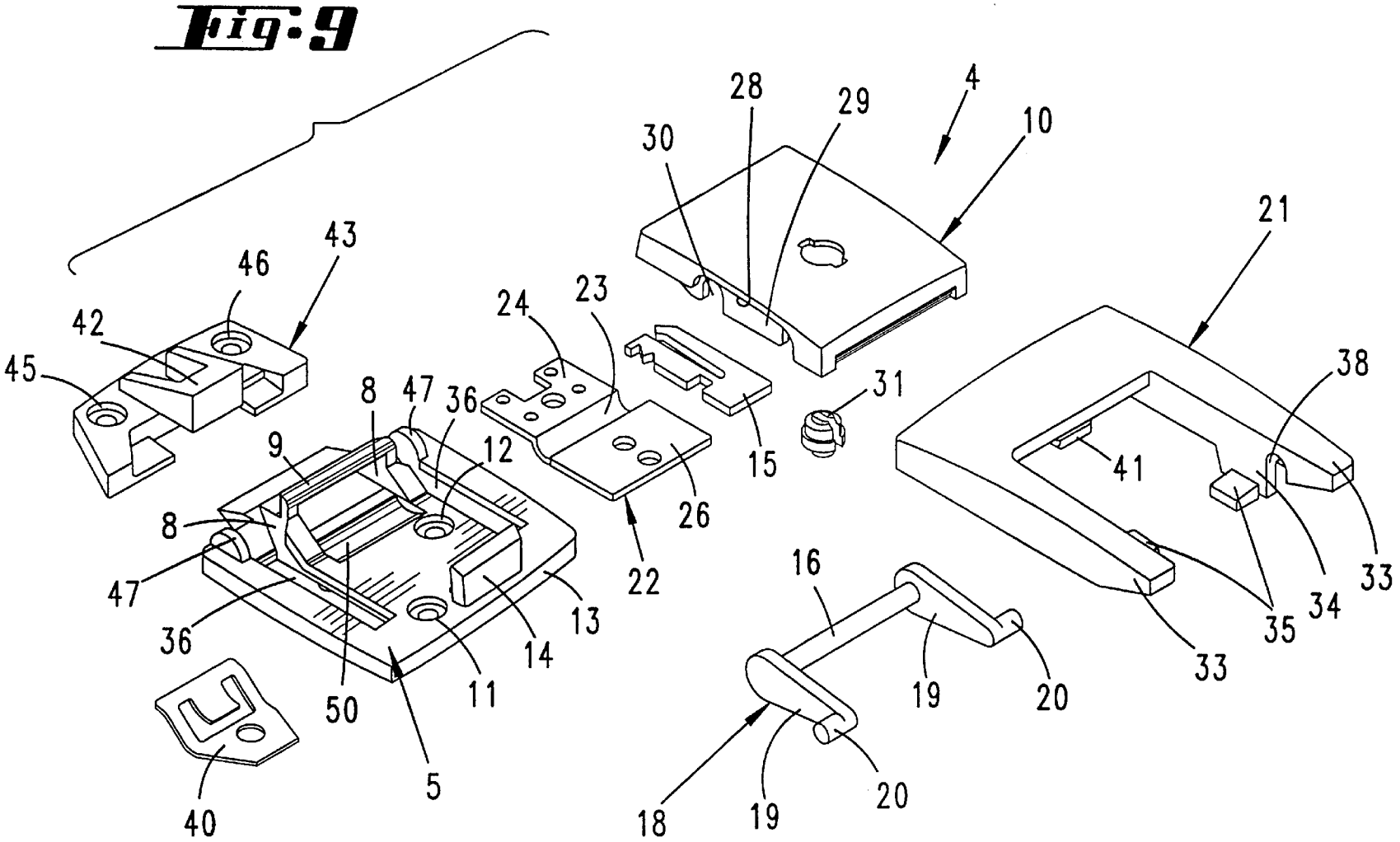
FIG. 9 is an exploded view of basic components of the drawbolt and the cooperable latch member.

As shown in FIG. 9, the base plate 5 is formed integrally with two parallel mounting blocks 8 that are integrally formed with a pivot shaft 9 extending between the mounting blocks. As later described, an actuating lever 10 is pivotally mounted on the pivot shaft 9. Two holes 11 and 12 extend through the base plate and are covered by the actuating lever 10 when the actuating lever is in a latched position shown in FIGS. 1 and 2, for example. The holes 11 and 12 accommodate rivets (not shown) for mounting the base plate 5 on the container and are disposed in the area between the pivot shaft 9 and an edge 13 of the base plate that is substantially parallel to the pivot shaft.

A bolt socket 14 extends from the base plate 5 adjacent to the hole 11 for receiving a lock bolt 15 to lock the actuating lever in the latched position. As will become apparent later, the lock bolt is guided for longitudinal movement on the actuating lever, transverse to and directly below a cross-bar 16 at the rear surface 17 of the actuating lever 10. The cross-bar 16 is part of a U-shaped link 18, and its opposite ends are formed integrally with arms constituted by parallel tapered plates 19. The free ends of the plates have outwardly extending pivot pins 20 that engage a U-shaped latch member 21, as later described.

Figure 7:
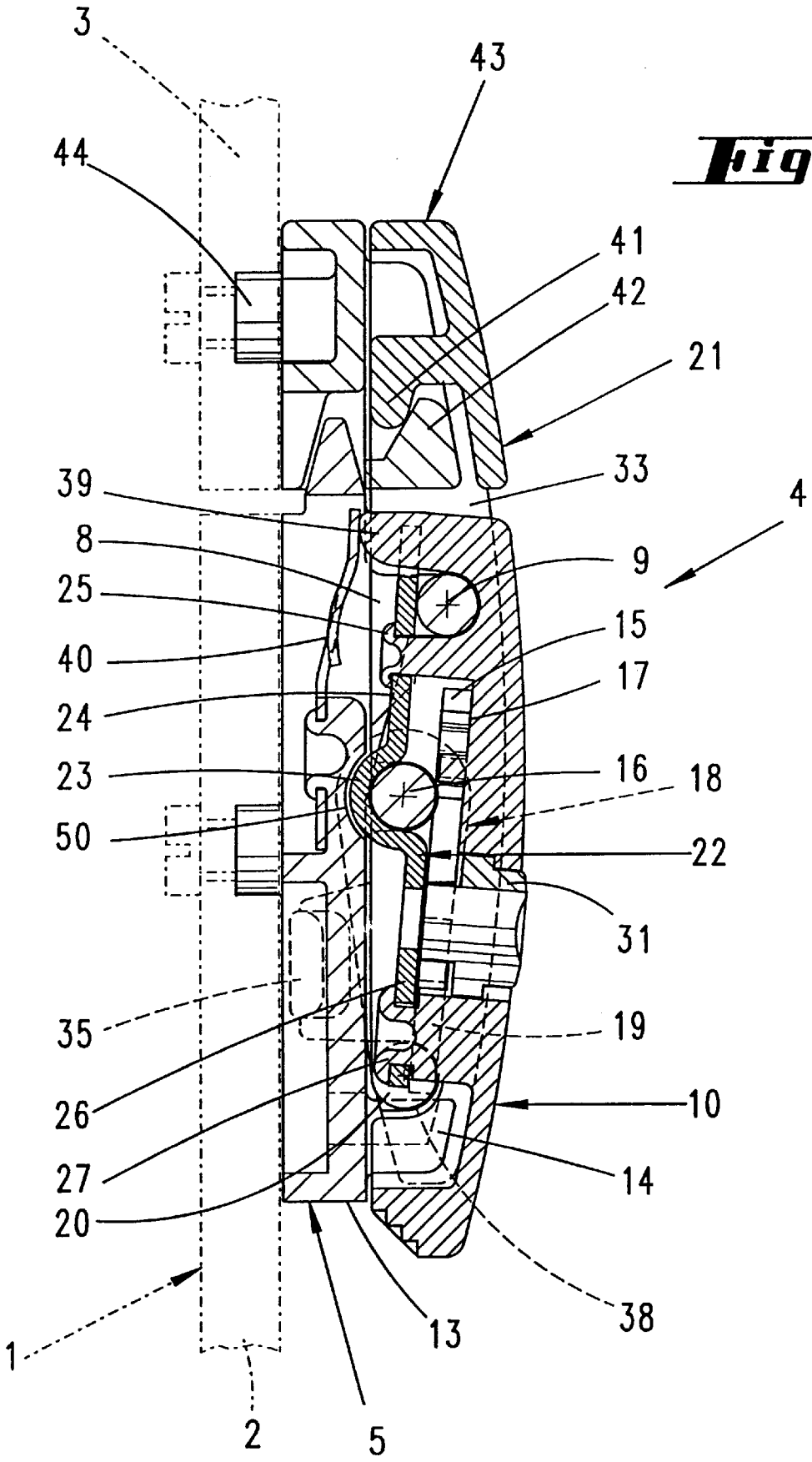
FIG. 7 is a longitudinal sectional view similar to FIG. 3 but with the lock bolt being shown in an unlocked position.

A back cover 22 embraces the cross-bar 16 with a cylindrical-section mounting cavity 23. An end section 24 of the back cover 22 extends below the pivot pin 9 and is riveted to the actuating lever 10. For this purpose, the actuating lever 10 has a riveting extension 25 at its rear, as shown in FIG. 7, for example. The opposite end section 26 of the back cover 22 contacts a surface of the lock bolt 15 and is also attached to the actuating lever 10 by a riveting section 27, as shown in FIG. 7, for example. In the latched position of the drawbolt, the end section 26 of the back cover extends close to the bolt socket 14 of the base plate 5.

Figure 6:
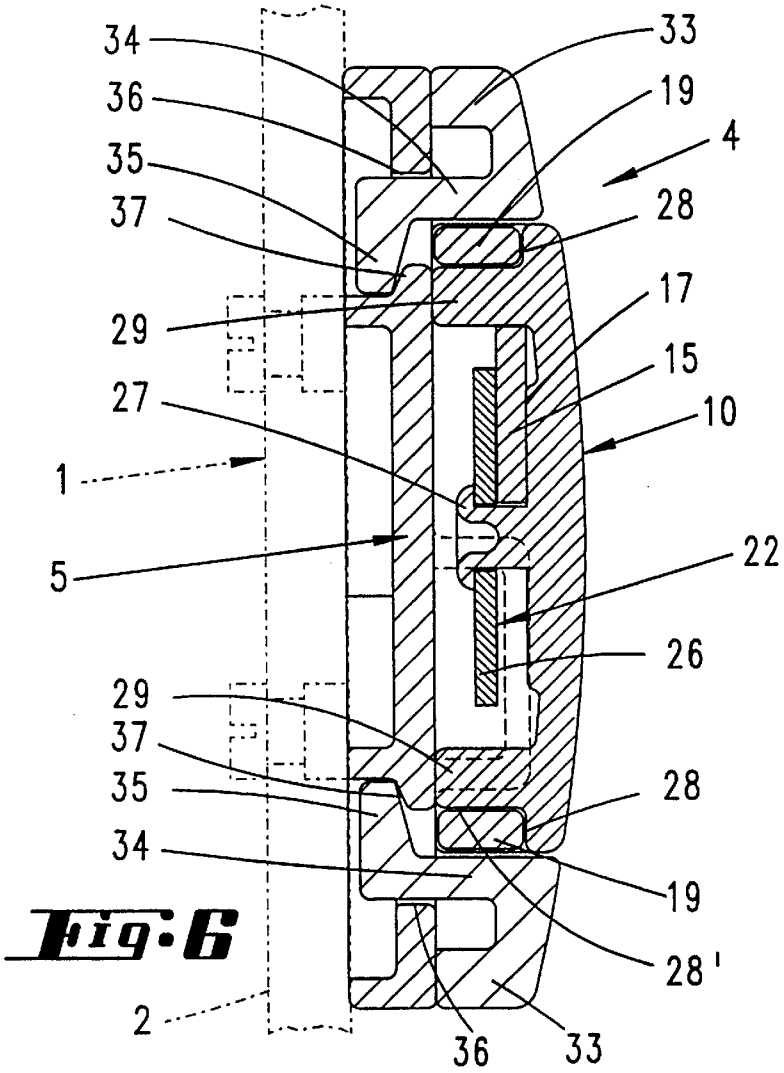
FIG. 6 is a transverse sectional view along line 6—6 in FIG. 3.

In the latched position of the drawbolt, the plates 19 of the U-shaped link 18 are received in and concealed by lateral pockets 28 formed at opposite sides of the actuating lever 10. See, in particular, FIGS. 5, 6, and 9. The bottoms 28' of these pockets are formed by lateral webs 29 of the actuating lever 10, which are parallel to one another and which are juxtaposed with the corresponding plates in the latched position. The webs have notches 30 for receiving portions of the cross-bar 16 adjacent to the plates 19. The plates 19, located in their pockets 28, ensure proper positioning of the U-shaped link 18 relative to the actuating lever 10.

One web 29 is used for guiding the lock bolt 15. The lock bolt extends between that web 29 and a key cylinder 31 supported on the actuating lever 10 along its longitudinal center line. The cylinder 31 receives a key 32 shown in FIG. 2. When the key is inserted in the lock cylinder and turned, the bolt 15 can be moved from the unlocked position shown in FIG. 7 to the locked position shown in FIG. 3, where an end of the bolt enters the bolt socket 14. As shown in FIGS. 1 and 9, the bolt socket 14 is eccentrically disposed, offset at one side of the longitudinal center line of the base plate 5. One of the rivet holes, 11, is disposed laterally of the bolt socket 14 at the opposite side of the center line of the base plate, and the other rivet hole, 12, is disposed between the bolt socket 14 and the pivot shaft 9. The rivet holes 11,12 and the bolt socket 14 define a right triangle.

Figure 4:
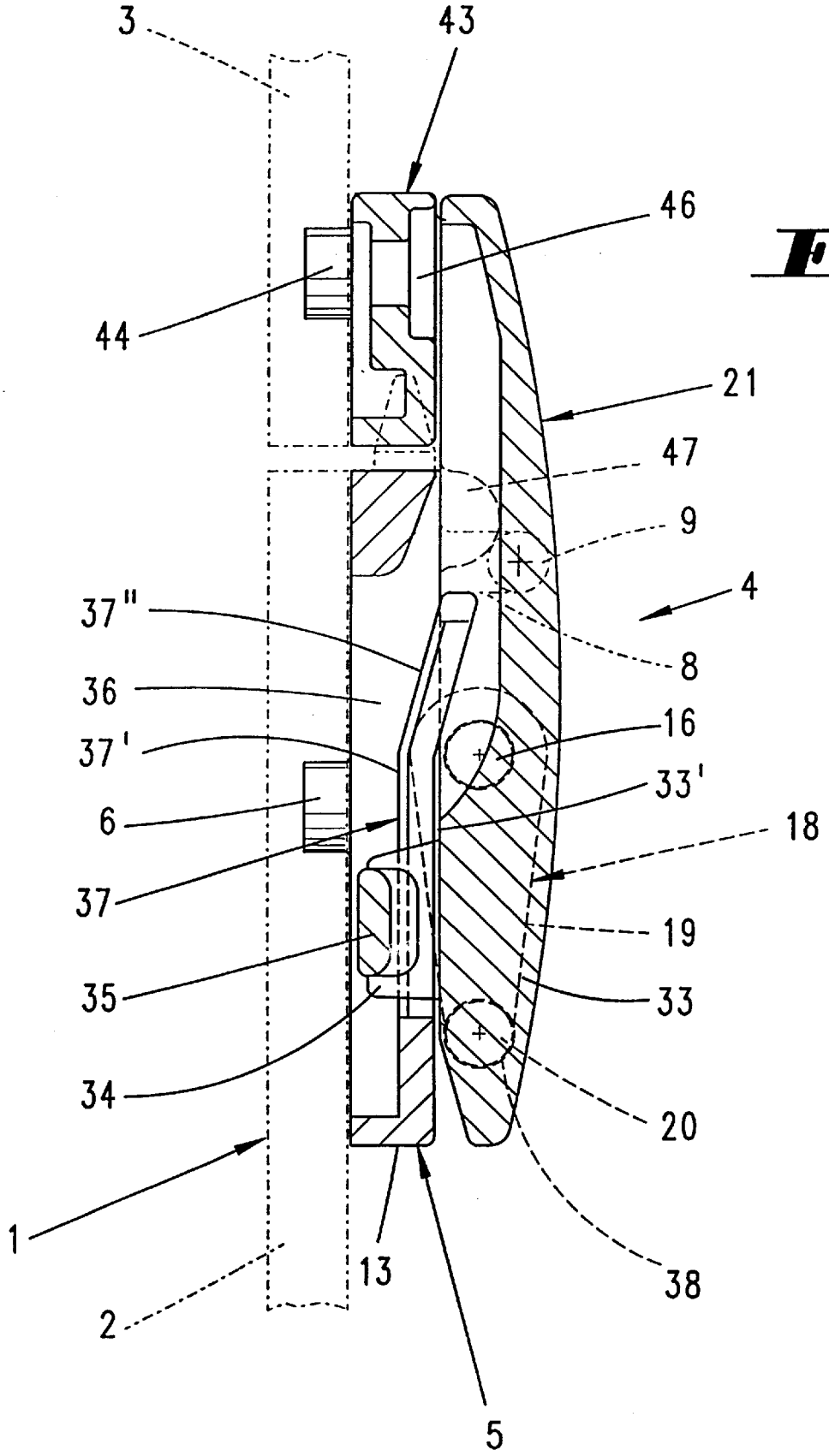
FIG. 4 is a longitudinal sectional view along line 4—4 in FIG. 1.

As shown in FIG. 9, the arms 33 of the U-shaped latch member 21 have lobes 34, and the lobes have guide elements 35 directed laterally toward one another. The lobes 34 extend through longitudinal slots 36 of the base plate 5, and the guide elements 35 slide along longitudinal guide surfaces 37 adjacent to the longitudinal slots 36. See FIGS. 4, 5, and 6. The guide surfaces 37 are formed by a section 37', which is parallel to the mounting surface of the base plate 5, and by an obtuse angled section 37". See FIG. 4. The base plate 5 is provided with cam blocks 47 that cooperate with longitudinal grooves in the underside of the arms 33 of the U-shaped latch member 21 in the manner described in the aforesaid U.S. Pat. No. 3,584,906. The pivot pins 20 of the plates 19 of the U-shaped link 18 are received in notches 38 in the arms 33 of the U-shaped latch member 21. See FIGS. 5 and 9.

Figure 3:
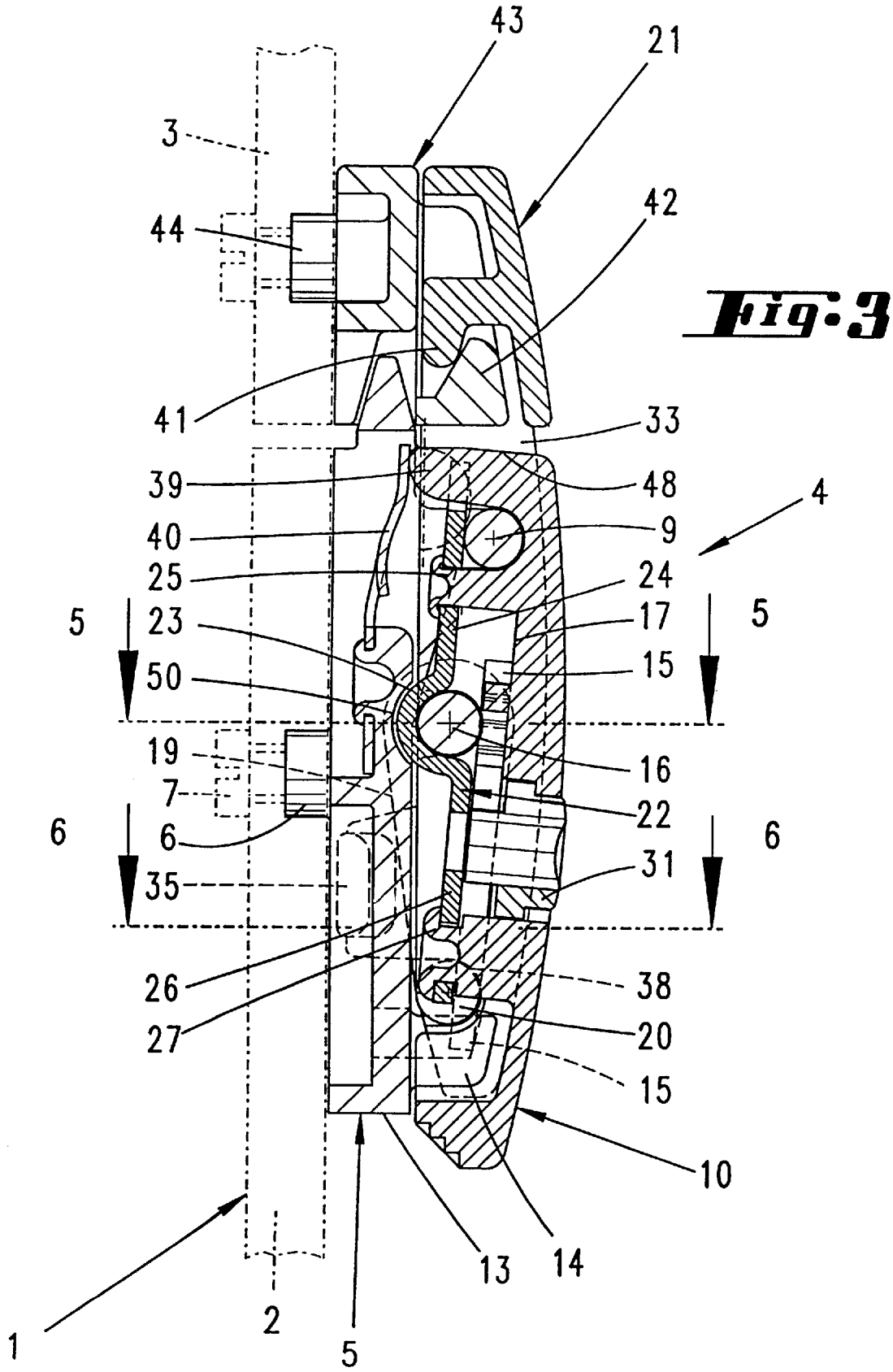
FIG. 3 is a longitudinal sectional view along line 3—3 in FIG. 1, a lock bolt being shown in a locked position.

The actuating lever 10 has a projection 39, that is located centrally on an extremity above the pivot shaft 9, as shown in FIGS. 3 and 7, and that engages a leaf spring 40 riveted to the base plate 5. Pressure of the leaf spring on the projection 39 maintains the actuating lever in its latched position, i.e., folded against the base plate 5. A latch element 41 of the U-shaped latch member 21 engages a cooperable latch element 42 of a latch member 43, mounted on section 3 of the container by means of internally threaded rear collars 44 and cooperating screws (see FIG. 2). Holes 45 and 46 at opposite sides of the latch element 42 permit riveting of the latch member 43 to the section 3 of the container, if required.

Operation of the drawbolt of the invention will now be described.

In the latched and locked position shown in FIG. 3, the latch element 41 of the U-shaped latch member 21 is engaged with the latch element 42 of the latch member 43, and the lock bolt 15 is received in the bolt socket 14. The key 32 (FIG. 2) may be inserted in the lock cylinder 31 and turned to move the lock bolt 15 to the unlocked position shown in FIG. 7, thereby extracting the lock bolt 15 from the bolt socket 14. Then, the lower end of the actuating lever 10 may be lifted by the user, whereby the actuating lever 10 and the latch member 21 can be moved to the unlatched position shown in FIG. 8.

As described in the aforesaid U.S. Pat. No. 3,584,906, the U-shaped latch member 21 at first moves longitudinally of the base plate as the actuating lever 10 is initially moved from the latched position shown in FIG. 7, with the guide elements 35 sliding along the guide surfaces 37', moving the latch element 41 parallel to the base plate 5 to disengage the latch elements 41 and 42. Then, by virtue of the angled surfaces 37" and the cam blocks 47, the latch member 21 is tilted away from the base plate 5, in order to free the section 3 of the container for movement away from the section 2, thereby to open the container.

Figure 8:
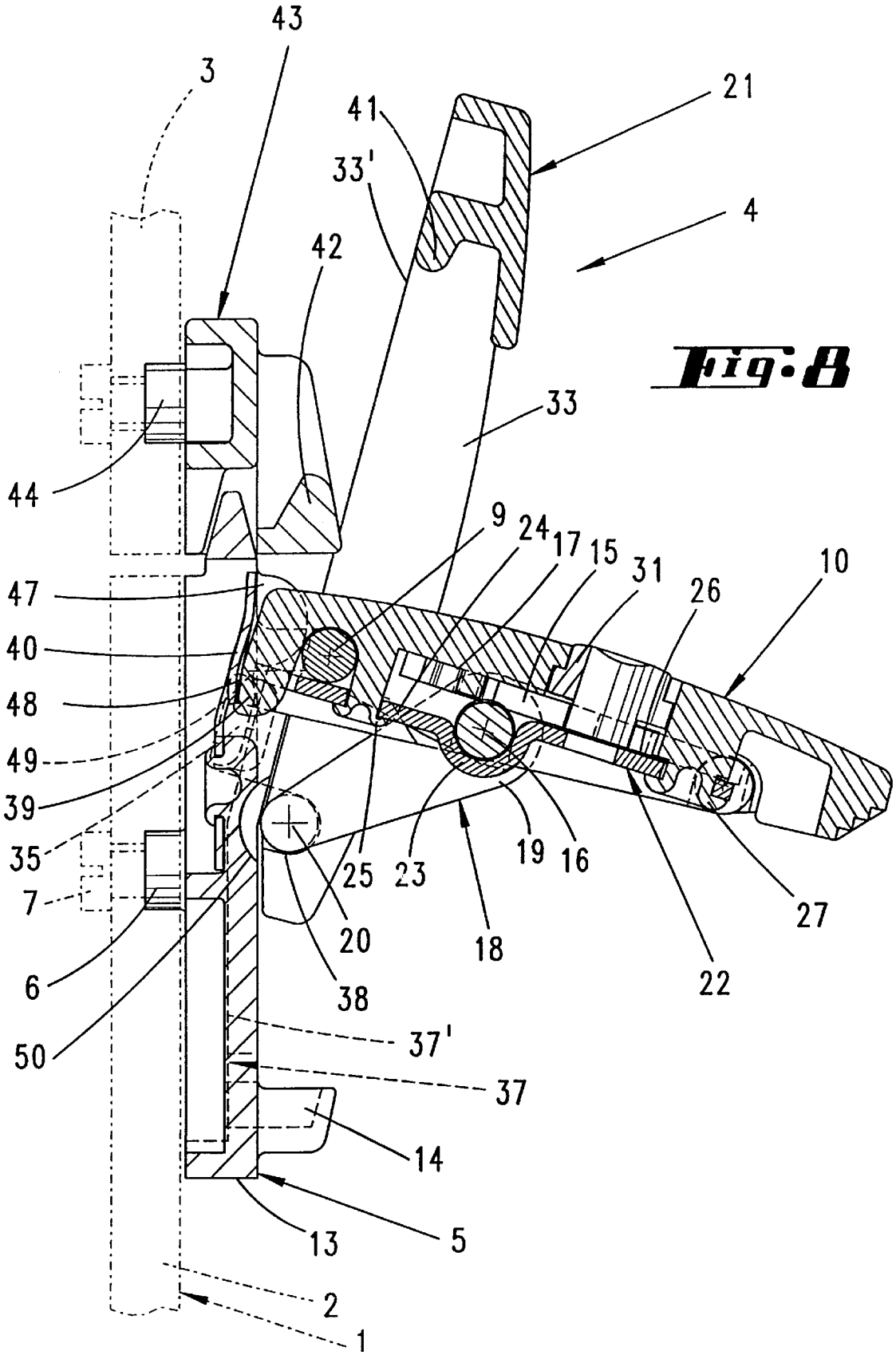
FIG. 8 is a longitudinal sectional view showing the drawbolt in an unlatched position.

When the section 3 has been moved toward the section 2, to close the container, the actuating lever 10 is turned toward the base plate 5, from the unlatched position shown in FIG. 8, turning the latch member 21 toward the base plate 5 and reengaging the latch elements 41 and 42. Continued turning of the actuating lever 10 toward the base plate 5 causes the latch member 21 to move parallel to the base plate to draw the section 3 of the container into a position firmly closed upon the section 2.

In the position shown in FIG. 8, the face 48 of the actuating lever 10 adjacent to the pivot shaft 9 exerts pressure on the leaf spring 40 to maintain the unlatched position of the drawbolt. Turning of the actuating lever 10 beyond the position shown in FIG. 8 is, at least in part, limited by the fact that the guide elements 35 act upon counter-faces 49 of the actuating lever 10.

The drawbolt of the invention has distinct advantages. It can be attached to a container, such as a luggage case, by riveting or bolting. The rivet holes 11 and 12 are easily accessible when the drawbolt is in the unlatched position, and riveting may be carried out without any interference. However, when the drawbolt is in the latched position, the rivet holes are covered and concealed. The rivet holes are arranged on the base plate in such a way that they are close to the point at which the lock bolt 15 is engaged with the bolt socket 14 to resist unauthorized opening forces.

There is no need for the actuating lever 10 to have mounting blocks on its rear surface to accommodate the cross-bar 16 of the U-shaped link 18. The cavity 23 of the back cover 22 is used for this purpose. When the cross-bar 16 of the U-shaped link is installed, the lock bolt 15 extends between it and the rear of the actuating lever, resulting in a low design height. The lock bolt 15 is guided for movement transverse to the cross-bar 16 and is supported by the cross-bar.

The lock bolt 15 is guided by a web 29 of the actuating lever 10 beside the key cylinder 31 located on the longitudinal center line of the actuating lever. Additional guide surfaces for the lock bolt 15 may be provided on the rear of the actuating lever 10. The bolt socket 14 is offset to the longitudinal center line of the base plate 5 and is located adjacent to an edge of the base plate, which has a stabilizing effect on the locked position. The bolt socket 14 forms a right triangle with the rivet openings, which contributes to an increase in stability.

Figure 5:
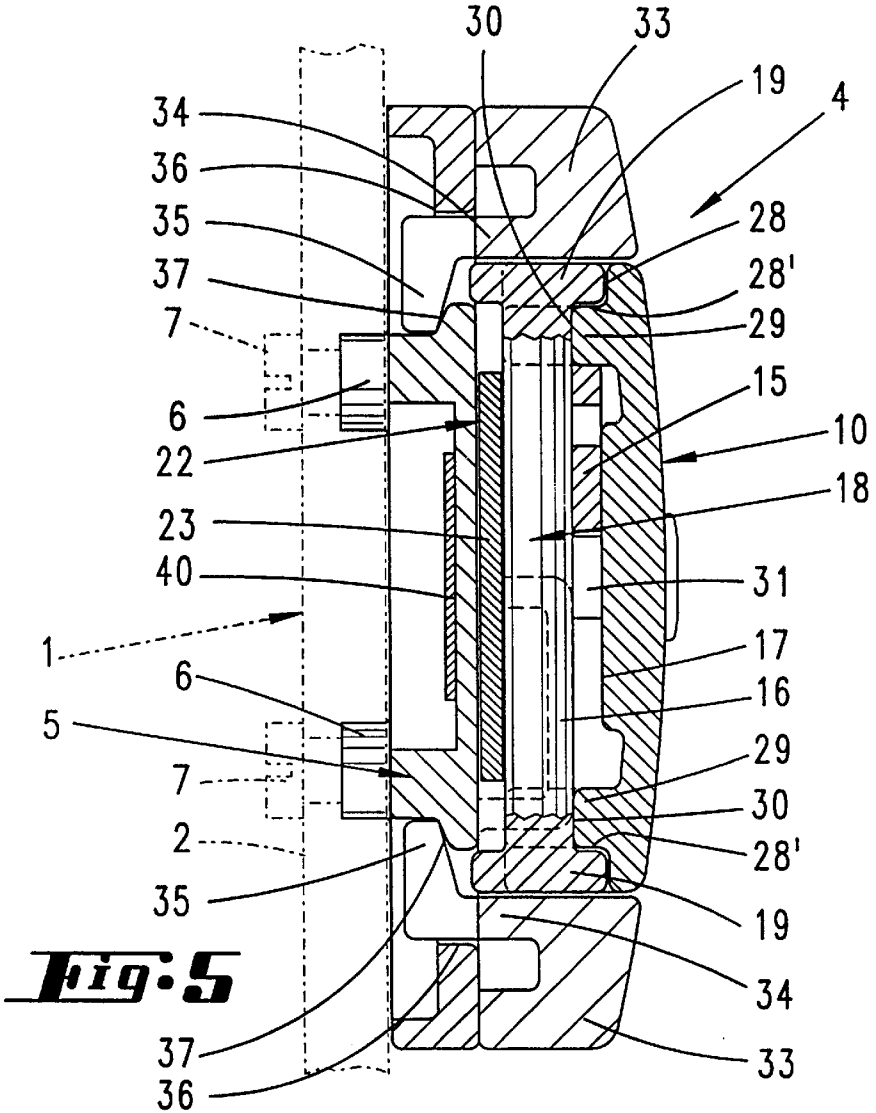
FIG. 5 is a transverse sectional view along line 5—5 in FIG. 3.

The arms of the U-shaped link 18 are formed as parallel plates 19 that partially mesh with recesses of the base plate when the drawbolt is in the latched position, as shown in FIGS. 3, 5, and 7, thus achieving high transverse stability. Pockets 28 of the actuating lever 10, which are open to the opposite sides of the actuating lever, further serve to accommodate the plates 19 of the U-shaped link, resulting in an optimum overlapping of base plate, link arms and actuating lever. The bottoms of the pockets 28 are formed by lateral webs 29 of the actuating lever 10 which have notches 30 for receiving the cross-bar 16 of the U-shaped link 18. The webs perform a dual function. On the one hand they serve for the accommodation of the plates 19. On the other hand, they provide mounting notches 30 for the cross-bar 16.

German Utility Patent Registration 22 400 DE filed Mar. 19, 1997 is incorporated herein by reference.

While a preferred embodiment of the invention has been shown and described, it will be apparent to those skilled in the art that changes can be made without departing from the principles and spirit of the invention, the scope of which is defined in the appended claims.

What is claimed is:

1. A drawbolt of the type comprising a base plate, an actuating lever, and a U-shaped latch member, the actuating lever being pivotally connected to the base plate for movement between a latched position and an unlatched position, and a U-shaped link connecting the actuating lever and arms of the U-shaped latch member, wherein the U-shaped link has arms formed as plates that are received in pockets that open at the sides of the actuating lever, the pockets being substantially closed by said plates when the actuating lever is in the latched position.

2. A drawbolt of the type recited in claim 1, wherein the arms of the U-shaped link have pivot pins that are received in corresponding notches at the sides of the actuating lever to connect the U-shaped link to the U-shaped latch member.

3. A drawbolt of the type recited in claim 1, wherein the pockets are formed in part by webs that are spaced inwardly of the side of the actuating lever and that are juxtaposed with the corresponding plates when the actuating lever is in the latched position.

4. A drawbolt of the type recited in claim 3, wherein the webs have notches that receive a cross-bar of the U-shaped link in the latched position.

5. A drawbolt of the type recited in claim 3, wherein the latch member has walls that are juxtaposed with the plates when the actuating lever is in the latched position.

6. A drawbolt of the type recited in claim 1, wherein the actuating lever has a back cover with a cylindrical-section cavity in which a cross-bar of the U-shaped link is mounted to connect the U-shaped link to the actuating lever.

7. A drawbolt of the type recited in claim 6, wherein the base plate has a cylindrical-section depression that receives the mounting cavity of the back cover when the actuating lever is in the latched position.

8. A drawbolt of the type comprising a base plate, an actuating lever, and a U-shaped latch member having space arm, the actuating lever being pivotally connected to the base plate for movement between a latched position and an unlatched position, and a U-shaped link connecting the actuating lever and the arms of the U-shaped latch member, wherein the actuating lever has a lock cylinder located on a longitudinal center line of the actuating lever and has a lock bolt offset at one side of the center line and supported for longitudinal movement on the actuating lever substantially parallel to the center line between an unlocked position and a locked position, and wherein the base plate has a bolt socket offset at one side of the center line of the base plate to receive the lock bolt in the locked position to maintain the actuating lever in a latched position.

9. A drawbolt of the type recited in claim 7, wherein the actuating lever has a back cover, and the movement of the lock bolt is guided by the back cover and a web formed at one side of the actuating lever.

10. A drawbolt of the type recited in claim 9, wherein the base plate has a pair of holes for receiving rivets to attach the base plate to a portion of a body to be latched, one of the holes being disposed between the bolt socket and the pivotal connection of the actuating lever to the base plate at one side of the longitudinal center line of the base plate under the lock bolt when the actuating lever is in the latched position, and the other hole being disposed laterally of the bolt socket at the opposite side of the longitudinal center line of the base plate, the holes being covered by the actuating lever in the latched position.

11. A drawbolt of the type recited in claim 10, wherein the holes and the bolt socket define a right triangle.

* * * * *